United States Patent [19]

Bigelow, Jr.

[11] Patent Number: 4,766,277

[45] Date of Patent: Aug. 23, 1988

[54] ROTARY ELECTRIC SWITCH

[75] Inventor: Warren B. Bigelow, Jr., Shelby, N.C.

[73] Assignee: General Electric Company, Brideport, Conn.

[21] Appl. No.: 933,802

[22] Filed: Nov. 24, 1986

[51] Int. Cl.[4] ..... H01H 21/04

[52] U.S. Cl. ..... 200/293; 200/303; 200/64; 174/52 R

[58] Field of Search ..... 200/293, 161, 294, 303, 200/64, 11 R, 153 F; 174/52 R; 29/622; 338/184, 199; 361/331; 220/3.2, 3.8, 341, 337

[56] References Cited

U.S. PATENT DOCUMENTS

| | | | |
|---|---|---|---|
| 1,031,399 | 7/1912 | Tirrill . | |
| 2,088,147 | 7/1937 | Weber et al. . | |
| 2,101,539 | 12/1937 | Figueira | 200/64 |
| 2,143,158 | 1/1939 | Lefkowitz . | |
| 2,349,655 | 5/1944 | Grout | 200/161 |
| 2,389,075 | 11/1945 | Nunes . | |
| 2,523,077 | 9/1950 | Unterschuetz et al. . | |
| 2,948,786 | 8/1960 | Scott . | |
| 3,128,355 | 4/1964 | Fuller | 29/622 |
| 3,643,052 | 2/1972 | Marshall, Jr. . | |
| 4,392,030 | 7/1983 | Buss | 200/11 R |

*Primary Examiner*—Henry J. Recla
*Assistant Examiner*—Linda J. Sholl
*Attorney, Agent, or Firm*—Hedman, Gibson, Costigan & Hoare

[57] ABSTRACT

A rotary switch including a housing having three integrally molded portions adapted to be folded into a body of the housing for holding the components of the switch in place.

6 Claims, 4 Drawing Sheets

ROTARY ELECTRIC SWITCH

BACKGROUND OF THE INVENTION

Self-returning rotary switches, of the type with which the present invention is concerned, have typically included a number of separate components assembled into a multiple part insulating housing and retained therein by an additional insulating piece which serves as a separate cover. Many problems, however, are encountered in the manufacture of such multi-part switches.

First, assembly of the housing from its several parts includes labor costs and also introduces increased dimensional tolerances which can lead to inaccuracies in the dimensional relations between the housing parts and the housed parts.

Secondly, all of the separate parts must be individually produced, stocked, handled and assembled.

Thirdly, assembly of the components contemplates positioning a torsion self-return spring actuator in the housing in combination with the switching components. In U.S. Pat. Nos. 2,143,158 (Lefkowitz) and 1,996,030 (Popp) the incorporation of such a self-return actuator spring must be carried out manually and the spring must be pre-loaded before the cover is attached. U.S. Pat. No. 2,088,147 to Weber et al teaches preloading the spring after attachment of the cover.

Also, where separately manufactured prior art components are employed, assembly requires reasonably substantial tolerances to accomodate manipulation of the various components. In this connection, the prior art housings employed include a conventional insulated box in which the insulating and conducting components are mounted, and a closure which, when secured, prevents access to the box interior. U.S. Pat. Nos. 2,088,147 (Weber et al); 2,523,077 (Unterschuetz et al); 2,948,786 (Scott); and 2,389,075 (Nunes) are all illustrative of these features.

In addition, conventional prior art switches generally employ separate and distinct terminals or contacts, which must be accomodated in various distinct locations within a housing. Thus, severe restrictions are placed on the configurations of the contact arrangement, the housing, and the terminal paths within the housing.

OBJECT AND SUMMARY OF THE INVENTION

It is therefore an object of the present invention to provide a multifaceted and multifunctional one-piece housing having a fold-in terminal-supporting platform board, a fold-in insulating and retaining member, and a fold over insulating cover section, each hinged separately to a switch housing so that they may be folded sequentially into the central compartment of the switch housing to effect assembly of the switch.

Another object of the present invention is to provide a unitary moulding for a switch which includes a switch housing, a terminal board, a retaining member and a cover, each of which is separately hinged and connected together by hinges.

Still another object is to provide a switch which is assembled to include a single piece terminal pad, the circuitry of which pad is modified at the time of switch assembly.

Yet another object is to provide a rotary switch including a torsion spring for driving the switching mechanism wherein torsional preloading of the spring is effected by very simple means after assembly of the switch.

Another object is to provide a versatile switch of simple construction at low cost.

Another object is to provide a switch having a unitary body which permits dimensional tolerances to be reliably maintained at low cost.

Another object is to provide a switch housing of unique unitary construction.

Other objects and advantages will be in part apparent and in part pointed out in the description which follows.

DESCRIPTION OF THE PREFERRED EMBODIMENTS

Figure 1:
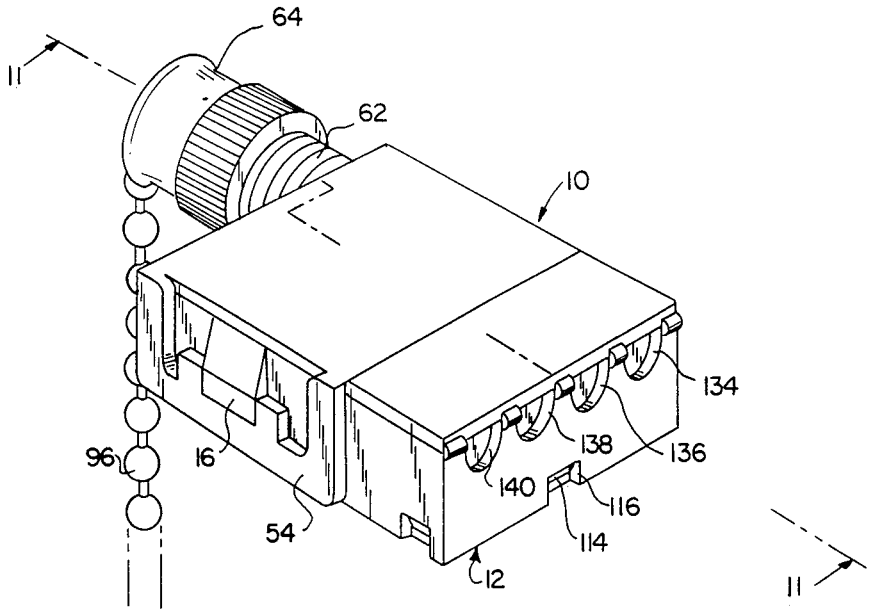
FIG. 1 is a perspective view of the assembled switch of the present invention.

Referring now to the drawings in which like or corresponding characters or numerals refer to like or corresponding elements, there is shown in the several figures the switch of the present invention.

Figure 4:
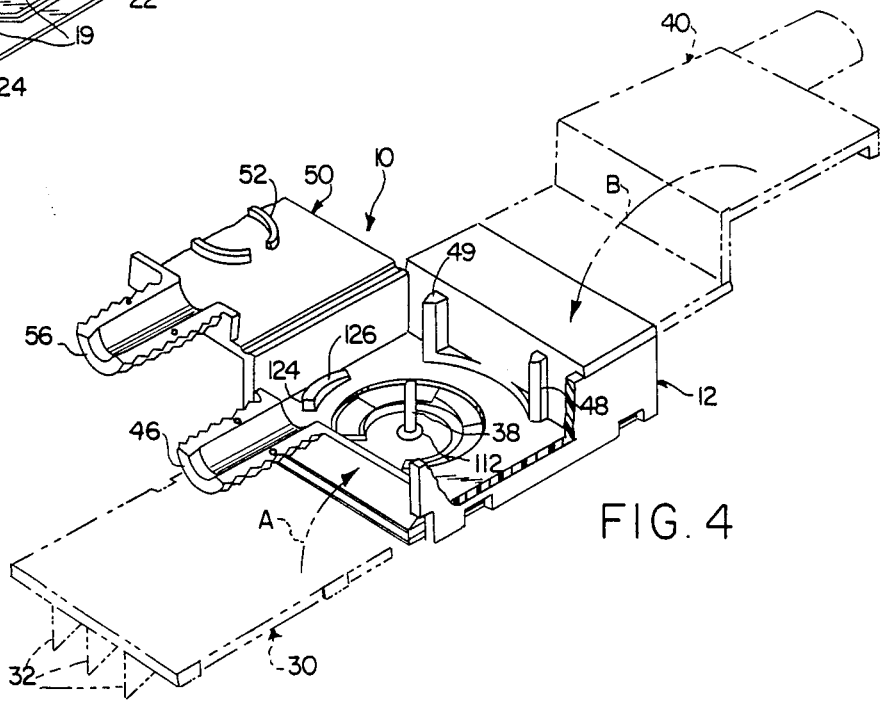
FIG. 4 is a perspective view of the partially assembled housing of FIG. 1, showing the pre-assembled portions in phantom.
Figure 3:
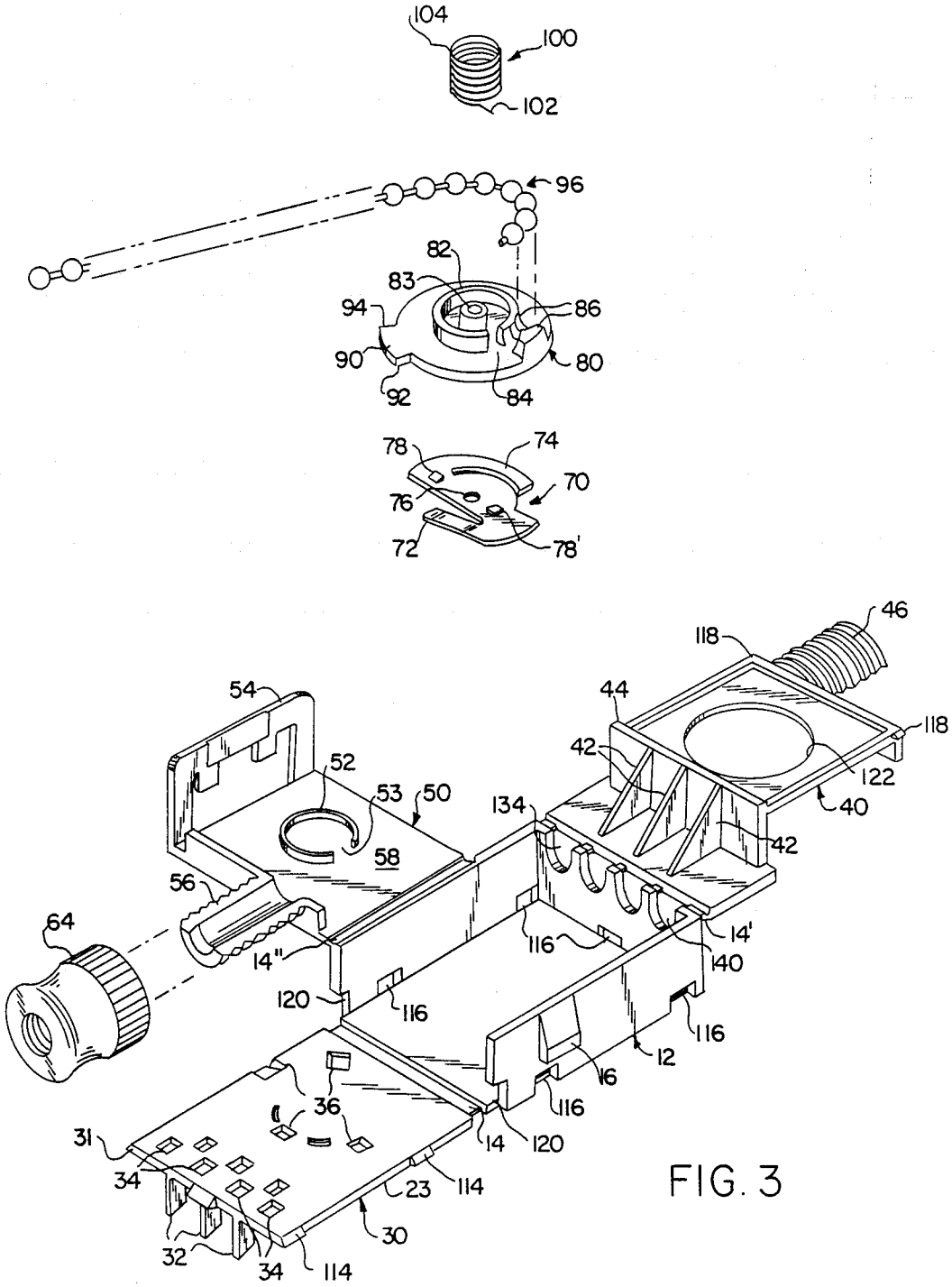
FIG. 3 is an exploded view of the unassembled switch components and housing illustrating the disposition of the various switch components of the present invention therein.

More particularly, as seen in FIGS. 1, 3 and 4, switch housing 10 includes a central portion or body 12, first folding portion 30, also designated as a platform board, second folding portion 40, also designated as a retaining member, and third folding portion 50, also designated as a cover. Each of the first, second and third portions is unitarily connected to body 12 by means of hinges 14, 14' and 14''.

First portion 30 is a planar rigid panel or platform board having a plurality of perpendicularly oriented end ribs 32 extending normal to a front end surface 31 as shown in FIG. 3. This front surface 31 faces forwardly until first portion 30 is rotated about 180° about its hinge 14 to locate the platform board into the compartment of body 12. First portion 30 includes a first set of slots 34 and a second set of slots 36, the first and second set of slots being arranged for receipt therein of first and second sets of tongues 24 and 22, respectively, carried by contact or terminal pad 20. The terminal pad 20 defines switching elements which constitute portions thereof, and is mounted to and carried by first portion 30. The pad 20 is mounted directly on the first portion 30 flat against the undersurface 23 of portion 30 as viewed in FIG. 3 with tongues 24 projecting through slots 34 and tongues 22 projecting through slots 36. When the sets of tongues are properly positioned through the sets of slots of panel 30, the tongues of pad 20 are folded against the top surface of the panel. A set of contacts 26 formed integrally with terminal pad 20 are disposed normal to the pad and are positioned at one end thereof in alignment with end 31 and residing between respective adjacent ribs 32. Two sets of conducting webs 19 and 21 are formed in the pad 20 when it is formed from strip stock. As the pad 20 is mounted and secured to panel 30, each portion of the strip is individually secured to the panel by a member of tongues included in the sets 22 and 24. After the pad 20 is assembled to the panel 30 and before further assembly of the switch elements, the sets of webs 19 and 21 are severed to electrically isolate the individual contact segments attached to panel 30 as best seeen in FIG. 7.

The undersurface 23 of first portion 30 further includes post 38 extending normal to the plane of surface 23 and extending also through aperture 28 of terminal pad 20. See FIG. 7 in which surface 23 is disposed as a top surface. Post 38 serves to maintain the concentricity of the several movable parts of the switching assembly necessary for proper operation thereof.

Second portion 40 includes a set of adjacent ribs 42, a clamping raised edge portion 44 and a half nozzle guide 46. The set of ribs 42 comprise slanted rib surfaces arranged to cooperate with the aligned ribs 32 of the first portion 30 to hold contacts 26 between the respective sets of ribs in insulated relation when the first and second portions have been folded in the compartment of base 12 of housing 10. The clamping raised edge portion 44 cooperates with the first portion 30 to firmly sandwich there between the terminal pad 20.

Half nozzle guide 46 cooperates with a second, substantially identical guide 56 carried by third portion 50 of housing 10 to define a cylindrical guide nozzle for the switch operator chain 96 when the two half nozzle portions 46 and 56 are folded into housing 10 as the portions 40 and 50 are folded in proper sequence.

Third portion or cover 50 includes spring guide collar 52, latch arm 54, and half nozzle guide 56, the latter having been described above. Spring guide 52 is a nearly circular collar extending normal to, and depending from, inner surface 58 of the third portion. When fully assembled, latch arm 54 is situated laterally opposite to hinge 14'' on the cover 50 and cooperates with latch ramp 16 on the outer wall of body 12 to hold the switch housing in a closed position after the first, second and third portions have been folded into housing body 12. After all components have been assembled in the housing as described below, the cover 50 is folded over body 12 so that latch arm 54 engages and latches with the latching ramp 16 thereon to lock the cover 50 in place, atop housing body 12. Half nozzles 46 and 56, at this point, abut and lie adjacent each other forming together a nozzle 62 having an inner channel, preferably of circular cross-section, to accomodate the switch operator, preferably a beaded pull chain 96.

Positioned within housing 10, are the switch components, one set of which is shown in exploded disposition in FIG. 3. The components, other than previously described component 20, include an electrically conductive, resilient rotary contact member 70, a rigid insulating rotary drive 80, beaded pull chain 96 and a coil spring 100 adapted to store and impart both compressive and torsional forces.

Subsequent to the mounting of the terminal pad 20 as described above on the housing first portion 30, the first portion 30 is folded 180° about integral hinge 14 into compartment 12 (as shown in FIG. 4 by arrow A). First portion 30 is provided at its outer edges with a plurality of locking tongues 114 which are positioned to snap into and lock in a plurality of matching pockets 116 in base member 12 as evident in FIG. 3. Rotary contact member 70, shown in plan view in FIG. 6 has an inner wiper contact arm 72 and an outer wiper contact arm 74 for interconnecting predetermined pairs of contacts carried by pad 20. Member 70 is positioned on shoulder 112 for rotation about post 38 formed integrally on the first section 30 in electrical contact with the contacts of terminal pad 20. Post 38 passes through the centrally located aperture 76 in member 70. As illustrated in FIG. 3, the rotary contact member 70, wiper arms 72 and 74 are located below the plane of the central portion of member 70. The central portion has upstanding ratchet tabs 78, 78' formed therefrom as evident in FIG. 3.

Second portion 40 of housing 10 is then folded 180° about hinges 14' (as shown in FIG. 4 by arrow B) so that the clamp-down edge 44 overlies, and bears against, terminal pad 20. The second portion 40 is clamped into place by the interaction of locking pads 118 with conforming and matching recesses 120.

Aperture 122 in portion 40 is larger in diameter than the diameter of rotary contact member 70 and accomodates the member 70 for rotation therein.

Figure 5:
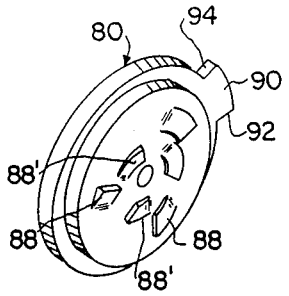
FIG. 5 illustrates the underside of a rotary drive as shown in FIG. 3.

Insulated rotary drive 80 is positioned above rotary contact member 70 and bears against the upper surface thereof. Drive 80 is an electrical insulator disposed at center hole 83 on post 38 of first portion 30. The underside of insulating rotary drive 80 is illustrated in FIG. 5. Drive member 80 includes an upstanding circular collar 82 having an opening 84, which collar is concentric with the post 38. A beaded chain retainer 86 is formed integrally on the upper surface of drive 80 and may take the form of opposing upstanding elements 86 (one of which may be formed as part of the collar 82). These elements 86 cooperatively define a neck portion for capturing and retaing therebetween an enlarged portion of the switch operating element, shown in FIG. 3 as beaded pull chain 96. The remainder of the pull chain 96 lies about collar 82 on the planar surface of carrier 80. The interior of collar 82 defines a receptacle into which the base of a coil spring 100 is positioned with a first end 102 of the spring being engaged in slot 84 formed in collar 82.

Figure 6:
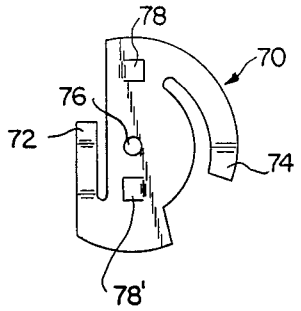
FIG. 6 depicts the rotary movable contact also shown in FIG. 3.

On the bottom side of drive 80, as shown in FIG. 5 of the drawings, a plurality of ramps 88 are provided for engagement with the punched ratchet tabs 78, 78' located on the upper surface of rotary contact member 70 which tabs are illustrated in FIG. 3. A second set of ramps 88' is disposed radially inwardly from the first set of ramps 88. These two sets of ramps 88 and 88' coact with respective tabs 78 and 78', respectively, found on the rotary contact 70 as seen in FIG. 6.

As pull chain 96 is pulled, the drive is angularly displaced to a predetermined position. In normal operation, after the drive 80 has been angularly advance by a pull chain 96, the drive is returned to its original position under the influence of coil spring 100 operating in its torsion mode.

The top of coil spring 100 is received within the confines of spring guide collar 52 with the second end 104 of the spring engaging the slot 53 formed in spring guide collar 52 (see portion 50 of FIG. 3). Drive member 80 further includes tab 90 having a radial surface 92 which coats with an upstanding limit member 48 formed integrally with the second portion 40 within compartment 12 after the second portion 40 has been folded into compartment 12.

In normal operation, the rotation of drive member 80 in response to a pull of chain 96 is limited by the contact of radial surface 92 of tab 90 with limit post 48. The rotary return of drive 80 under the influence of coil spring 100 is limited by the engagement of vertical surface 124 of ramp 126 with radial surface 94 of tab 90. In this way, when drive 80 is rotated about post 38, rotation of tab 90 is angularly confined to the distance between limit members 48 and 126. The angular displacement of drive 80 during a normal operation of the switch drive mechanism described above from the initiation of rotation by exerting a pull on chain 96 to the termination of that initial rotation as surface 92 hits stop 48 is determined by the width of tab 90 and accordingly by the angular distance between radial surfaces 92 and 94 of tab 90.

During such normal rotation of drive 80 the rotary contact member 70 is in turn driven in the same direction and through a slightly smaller angular displacement due to the engagement of the rings of ratchet teeth 88 and 88' of rotor 80 with the raised ratchet tabs 78 and 78' respectively of the contact member 70.

However, as the chain 96 is released and the coil spring 100 induces rotary motion of drive 80 and withdrawal of chain 96 from its extended position, no comparable return motion of contact member 70 occurs. Such return of member 70 is prevented by engagement of depended spring wiper contact arms 72 and 74 with reverse latch members 128, 130 and 132 formed integrally into the surface of portion 30 of housing 10, (See FIG. 7).

As the rotary contact member 70 is angularly advanced with the angular motion of drive 80, the depending wiper arms 72 and 74 are also angularly displaced into the next sequential position on terminal pad 20. Arm 72 always maintains contact with ring-shaped central contact 26''' of pad 20. However, arm 74 makes and breaks contact in sequence with the remaining contacts of the terminal pad. Contact is made when the arm 74 wipes a metal surface of a contact as illustrated in FIG. 7 and breaks contact when arm 74 wipes the plastic ramp surfaces 128, 130 and 132 between the contacts.

Referring back now to the prior paragraph in which the normal rotation of drive 80 proceeds through an angle which is slightly larger than the normal rotation of driven element 70, the reason for the slightly larger angular displacement of the driving element 80 is that an allowance must be made for the tolerance difference between the set of driving ramps and latches on the bottom of drive element 80 and the corresponding ramps and latches extending up from driven element 70. The angle of rotation is slightly larger for drive element 80 to ensure that driven elements 70 will be engaged for the succeeding driving cycle after the drive element 80 returns to its initial position under the influence of the spring 100.

Figure 2:
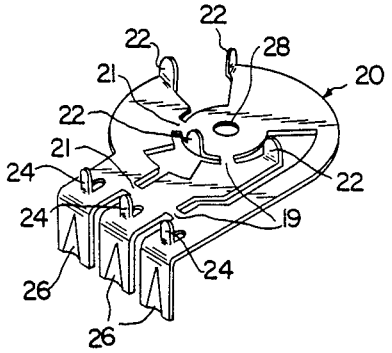
FIG. 2 is a perspective view of the terminal pad.
Figure 7:
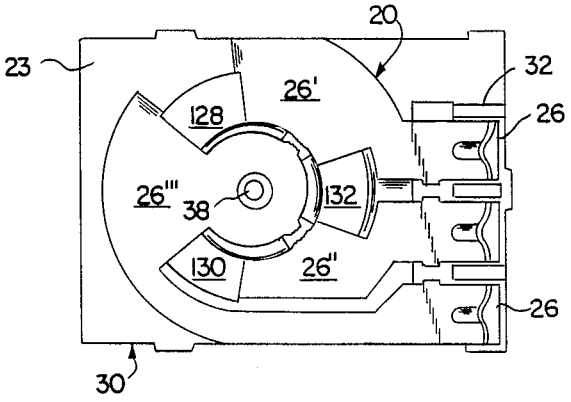
FIG. 7 is a partial top plan view of the terminal pad mounted in place on the platform board.
Figure 8:
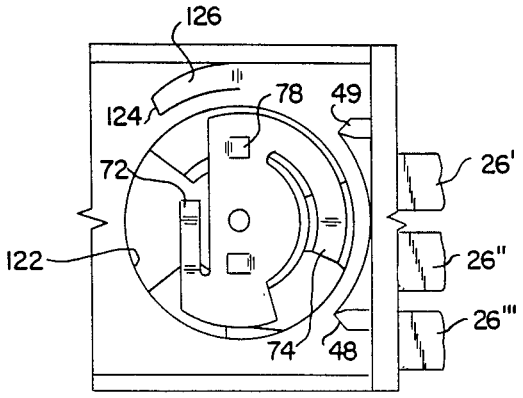
FIG. 8 is a partial top plan view of the housing of FIG. 4 illustrating the assembly of the retaining member over the platform board and illustrating the rotary movable contact positioned within an opening of the retaining member.

In FIG. 7, a partial assembly of the structure of the present invention is shown. Particularly, the pad 20 is shown mounted in the housing 10. Two things are evident from FIG. 7 in this sub-assembly of the pad 20 into housing 10 on first section 30 of the housing. The first thing which is shown is that although pad 20, as illustrated in FIG. 2 shows all of the different conductive elements interconnected, once it is mounted in the housing as shown in FIG. 7, the links 19 and 21 which appear in FIG. 2 are shown to be absent from the pad 20 as illustrated in FIG. 7. The removal of these sets of connecting links 19 and 21 is responsible for the separation of the contact pad 20 into separate electrically isolated individual contact members 26' and 26'' and 26'''.

Referring now to FIG. 7, which illustrates the contact pad 20 positioned on the support 30 between ramps 128, 130 and 132, it is to be understood that the ramps are sloped from a lower plane to a higher plane as one proceeds in a counter-clockwise direction while the contact surfaces 26', 26'' and 26''' are all located at the lower plane. Specifically, the right most edge of ramp 128 is on the same plane as contact surface 26', thereby providing a smooth transition for upper arm 74 as it is rotated counter-clockwise across contact surface 26' and onto ramp 128. As the upper arm 74 continues to be rotated counter-clockwise, it rides up the ramp 128 to a higher plane at the left most edge before it snaps down off the ramp 128 and onto contact surface 26'''.

The upper arm 74 is prevented from reversing, i.e., rotating in a clockwise direction by the left most edge of ramp 128 which is at a high level relative to the lower plane contact surface 26'''.

Similarly, ramps 130 and 132 have their counter-clockwise leading edge on the same lower plane as their respective contact surfaces 26''' and 26''. The upper arm 74 is thereby prevented from rotating in a clockwise direction as it is advanced across each of said ramps 128, 130 and 132 and onto successive contact surfaces 26', 26'' and 26'''.

Figure 9:
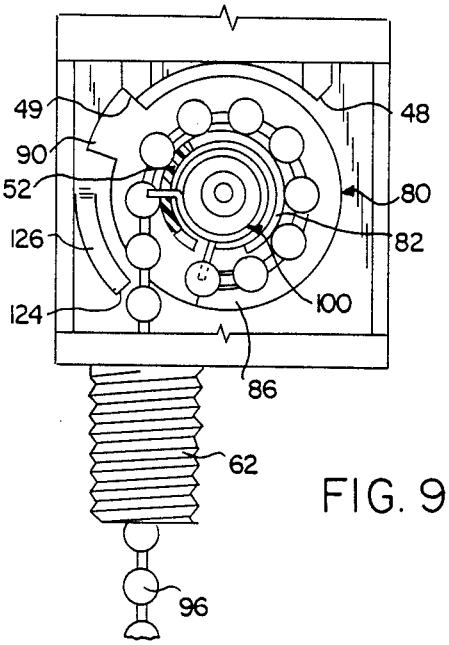
FIGS. 9 and 10 illustrate the initial sequential operation by which the pull chain is automatically set from its unbiased condition to its biased or pre-loaded condition immediately following assembly.
Figure 10:
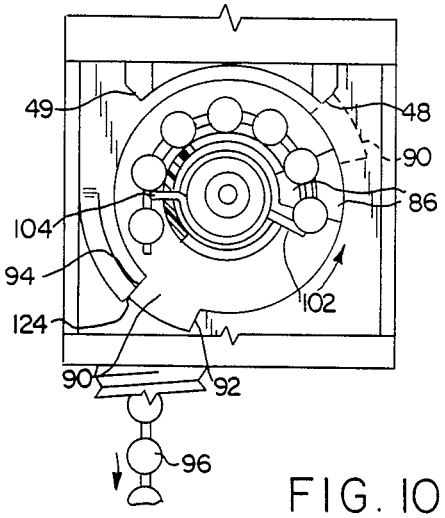

As described above, the rotary drive 80 is activated by a pull chain 96 once the pull chain is positioned in the receiving chain retainer on the drive 80 and is extended or laid around the collar 82 which is formed integrally with the insulating rotary drive 80. The chain extends from the rotary drive, which it actuates when the chain is pulled, to the exterior of the switch housing. Referring now to FIGS. 9 and 10, the relationship of the chain displayed in the interior of the housing 10 with the outer cover 50 removed, and the threaded nozzle 62, made up of the two halves 46 and 56, to extend free of the housing is shown at the bottom of the FIG. 9. The extent of chain 96 which extends beyond the housing is accessible to the user of the switch and constitutes the member which one can grasp and pull in order to make the internal mechanism of the switch operate in the manner described above.

When the switch components are assembled, the insulating rotary drive 80 is positioned in the housing in the position shown in FIG. 9 with the radially extending surface 94 of tab 90 abutting the stop 49 formed integrally in the housing and described above.

When the external portion of the chain 96 is first pulled, the tab 90 is moved through an arc past the ramp 126 and past the vertical latching surface 124 of ramp 126 to a position where the tab surface 92 abuts the stop 48, also formed integrally in the switch housing.

After the tab 90 has been moved through the large arc from its at rest position against stop 49 to a position abutting stop 48, the spring 100 which has been put under torsion by the movement of the rotor, acts to return the tab 90 to its original position. However, as the tab moves back toward the stop 49, it is interrupted and stopped by the vertical surface 124 of the ramp 126 and does not proceed beyond that stop, namely, the vertical stop surface 124 of ramp 126. The radial surface 94 of the tab 90 accordingly comes to rest against the surface 124 under the bias of the spring 100 and for all future operation of the switch the contact of the tab 90 with the surface 124 contitutes the atrest position for the tab 90.

In fact, it is not necessary to pull the spring sufficiently far to drive the rotor 80 all the way around to bring the tab 90 into contact with stop 48, but the tab and, particularly the radial surface 94 of tab 90, must move up and over the ramp 126 and past the vertical surface 124 which subsequently serves as a latching surface to prevent the return of the tab 90 to its initial position proximate stop 49.

Accordingly, the spring 100 is biased by the initial pull on chain 96 and remains biased so that each time it is pulled at a subsequent activation of the switch, it starts from the biased position given to it by this initial movement as described immediately above.

The position of the tab 90 in its normal at rest position, once the use of the switch has been started, is shown in FIG. 10 with the tab 90 resting against the ramp 126 at the surfaces 94 and 124 thereof, respectively.

Figure 11:
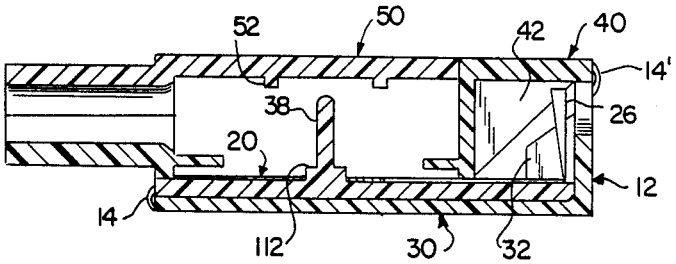
FIG. 11 is a sectional view of the housing of the switch taken along the broken line 11—11 of FIG. 1.

Referring now to FIG. 11, there is shown a vertical sectional view of the housing of the switch with the various foldable parts of the housing folded into place but with the movable part omitted. In addition, the pad 20 is shown mounted in the floor of the housing on portion 30 and the center pole 38 is shown extending up from the floor of the housing through the pad 20. The pad extends around the base of the post 38, which post has a shoulder 112. The section through the housing as shown in FIG. 11 is taken along the broken line 11—11 of FIG. 1.

Turning now to FIG. 1, an isometric view of the fully assembled switch housing is illustrated. The chain 96 depends from a decorative nozzle nut 64 which is threaded onto the externally threaded nozzle 62.

The housing 10 is equipped with wire ports 134, 136, 138 and 140 which are formed integrally in the central portion 12 of the switch housing and which provide the ports through which all conductors are assembled to the conductive elements within the switch. Accordingly, all current flowing to or from the switch flows through the wires (not shown) which enter the ports 134 through 140.

Considering the pad 20 as shown in FIG. 2, once this particular form of pad is assembled to the housing as shown in FIG. 3, only the ports 136, 138 and 140 would be employed. This is because the contacts 26', 26'' and 26''' which provide both a wire receiving and wire locking contact for the entering wires are three in number and would present contact receiving conductors only at the ports 136, 138 and 140.

By the omission of a contact such as 26''' or by inclusion of additional contacts, it is evident that switching capability for two, three or four contacts can be provided.

Accordingly, it is evident that a very novel, unique and desirable set of properties is built into a very small structure having very extensive versatility in use for two, three or four conductor switches, and that very significant reliability in the fabrication of the switch is accomplished by having all of the housing parts formed as a single molded piece to be then assembled by folding the several component parts thereof into a finished switch housing as illustrated in FIG. 1. Further, great simplicity is achieved because all of the internal stationary conductors are made as a single piece, specifically as pad 20, and the pad is then mounted as a single piece to a portion of the switch housing and is separated into the multiple elements after it has been assembled and secured to the portion of the housing. Because of the multiple stationary conductor parts and the ability to include those in the housing with great economy of material and effort, multiple actions can be accomplished by this single switch mechanism depending on the pad which is employed and depending of the rotor which is incorporated into the housing in cooperation with the moving conductive element 70. Accordingly, with this switch as shown it is possible to achieve three levels of energy delivery from the rotation of the element 70. One is a full OFF energy level, a second is a typically low energy level, and a third is a high energy level, or off/half-on/full-on.

By a modification of the insulating drive 80 and the portion 30 of the housing and by incorporating a pad such as 20 having four wire contacts, it is further possible to achieve an additional switching level. For example, if the fourth contact is incorporated, the switch can accomodate an OFF, a LOW, a MEDIUM and a HIGH level of energy being delivered from the switch to whatever is being actuated by current flowing through the switch.

I claim:

1. A rotary switch housing, comprising:

a molded insulating body having a compartment and open at top for receiving integrally molded portions hingedly attached to three sides of said body including a first portion having means that allow said first portion to mount an electrical contact pad thereon, and being foldable into the bottom of said compartment, a second portion having means that allow said second portion to be folded over said first portion, including means for securing said contact pad in said compartment and a first half-port for extending a switch actuator to the housing exterior from the housing interior, and a third portion having means that allow said third portion to be folded over said second portion to provide a closure for said compartment, including a second half-port that mates with said first half-port so as to provide a full port for extending said switch actuator to the housing exterior from the housing interior.

2. The rotary switch housing of claim 1, wherein said first portion is provided with a central post adapted for receiving an insulated rotary drive within said compartment.

3. The rotary switch housing of claim 1, wherein said third portion includes a latch are for engaging a latch ramp on said body to secure the switch housing in a closed position after said first and second portions have been folded into said housing.

4. The rotary switch housing of claim 3, wherein said third portion includes an integrally molded spring collar extending normal to an inner surface of said third portion.

5. A rotary electrical switch, comprising:

a molded insulating body having a compartment and open at top for receiving integrally molded portions hingedly attached to three sides of said body including a first portion foldable into the bottom of said compartment including a central post extending through an aperture disposed in an electrical contact pad mounted on said first portion and wherein said contact pad includes a plurality of switching elements;

a second portion having means that allow said second portion to be folded over said first portion including means extending from said second portion for securing said contact pad and said switching elements in insulated relation;

an insulated rotary drive having a central aperture for mounting on said central post;

a rotary contact member attached to one side of said rotary drive for engaging the switching elements of said contact pad;

means to acutate said rotary drive extending from said drive to the exterior of said switch body;

a third portion having means that allow said third portion to be folded over said second portion to provide a closure for said compartment including an integrally molded spring collar extending normally from said third portion into said compartment; and means positioned on said spring collar and adapted to impart compressive and torsional forces on said rotary drive against a force applied by said actuating means.

6. The rotary electrical switch of claim 5, wherein said actuating means is a beaded pull chain attached to said rotary drive.

* * * * *